United States Patent [19]

Hull et al.

[11] Patent Number: 4,944,392

[45] Date of Patent: Jul. 31, 1990

[54] COMBINATION MATCH SAFE, KNIFE AND STRIKER

[76] Inventors: Harold L. Hull, 401 Canyon Way, Sp. 43, Sparks, Nev. 89434; Thomas D. Newton, 136½ W. 2nd St., Reno, Nev. 89501

[21] Appl. No.: 440,720

[22] Filed: Nov. 24, 1989

[51] Int. Cl.[5] ..... B25F 1/00; A24F 27/00

[52] U.S. Cl. ..... 206/102; 7/118; 7/158; 30/125; 30/151

[58] Field of Search ..... 206/102; 7/118, 158, 7/167; 30/151, 124, 125, 329, 332, 337

[56] References Cited

U.S. PATENT DOCUMENTS

| | | | |
|---|---|---|---|
| 502,351 | 8/1893 | Dean | 206/102 |
| 544,691 | 8/1895 | Rupprecht | 206/102 |
| 638,555 | 12/1899 | Burton | 30/125 |
| 666,720 | 1/1901 | Wetmore | 7/167 |
| 1,328,988 | 1/1920 | Eckert et al. | 206/102 |
| 2,651,840 | 9/1953 | Taylor | 30/151 |
| 2,904,373 | 9/1959 | Dowdy et al. | 7/167 |
| 3,461,469 | 8/1969 | Morrison | 7/14.25 |
| 4,669,186 | 6/1987 | Liu | 30/125 |
| 4,698,068 | 9/1987 | Jensen | 44/39 |
| 4,727,609 | 3/1988 | Smith, Jr. | 7/145 |

FOREIGN PATENT DOCUMENTS

| | | | |
|---|---|---|---|
| 11406 | 11/1895 | Switzerland | 206/102 |

*Primary Examiner*—Roscoe V. Parker

[57] ABSTRACT

A combination match safe and knife which can safely be carried in a pocket in a closed position with the knife portion being reversible, that is, in one position, the knife blade and matches are enclosed inside the container, while in a second position the knife blade is positioned outside the container and the container becomes a handle. The device also has a striking surface for the matches and a flint which the knife can be sharply struck against to produce a spark.

9 Claims, 1 Drawing Sheet

COMBINATION MATCH SAFE, KNIFE AND STRIKER

FIELD OF THE INVENTION

This invention relates to a survival tool, namely, a tool which involves a knife and a means of keeping matches dry and a means of striking a spark.

BACKGROUND OF THE INVENTION

In the past, there have been proposed a variety of combination tools designed for the use of the outdoorsman such as a hunter, fisherman, camper, hiker, military personal or other persons traveling light in the outdoors, who may want a simple multi-purpose device which can be carried on the person but be readily available, however, the prior art has provided tools which are clumsy, bulky or complicated such as the survival tool of U.S. pat. No. b 4,727,609, which includes a shovel blade, axe, hammer, knife blade, and a bow and arrow. Also, U.S. Pat. No. 4,669,186 teaches a complicated two knife system and a hollow handle which leaves one of the knives exposed while not in use.

SUMMARY OF THE INVENTION

It is a primary purpose of the present invention to provide a simple solution to two of the most important problems which occurs in surviving in natures outdoors, i.e., that of making a fire and that of providing a knife. It is a further object to provide a device that carries matches in a water proof container, often referred to as a "match safe."

It is a further object to provide a device that keeps the blade covered when not in use for safe transport.

Still another object is to provide a means of starting a fire by means other than matches if necessary by providing a striker on the device, which, when the knife portion being metal is struck against, will produce a spark.

Another object is to also provide a convenient striker for the matches.

Still another object is to provide means to keep the knife and matches in a closed compartment when not in use that is not only water tight but houses the matches and the knife in such a manner that the device can be safely carried in a pocket.

Other objects and advantages will become obvious when taken in consideration with the following drawings and specifications.

DETAILED DESCRIPTION OF THE DRAWINGS

Figure 1:
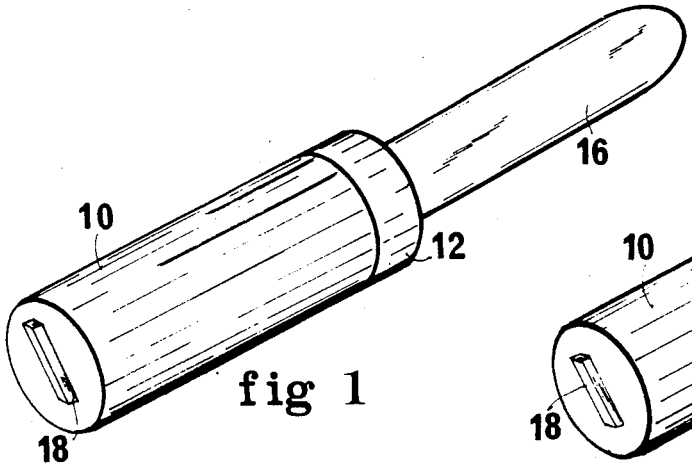
FIG. 1 is a perspective view of the device in an open position.
Figure 2:
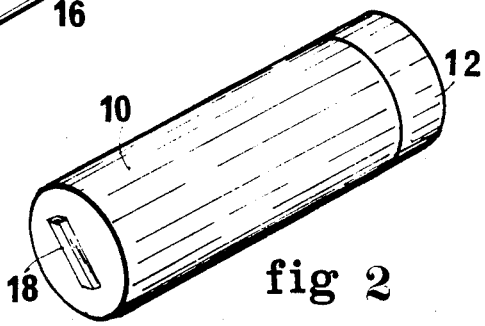
FIG. 2 is a perspective view of the device in a closed position.
Figure 3:
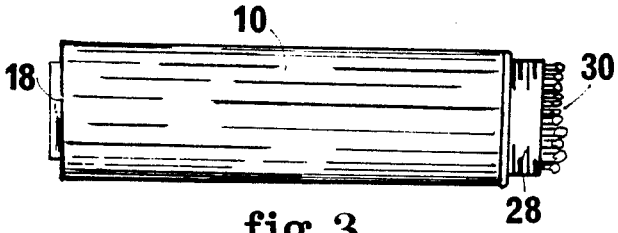
FIG. 3 is a side view of the open compartment containing matches.
Figure 4:
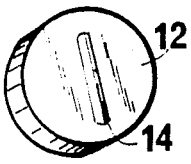
FIG. 4 is a perspective view of the cap or lid.
Figure 5:
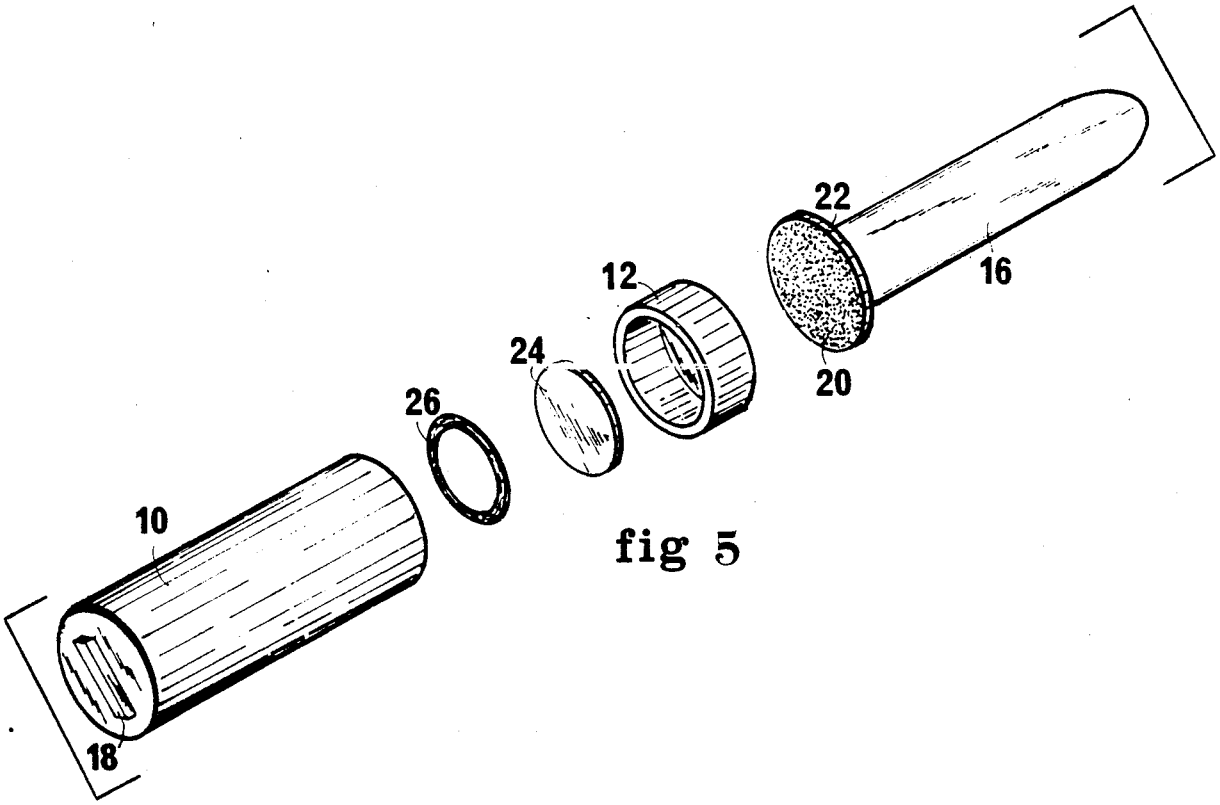
FIG. 5 is an exploded perspective view showing all the parts.

Referring now to the drawings in which like numerals refer to like parts throughout the various views, 10 is a container, such as a "match safe," with a cap or lid 12 which contains slit 14 and knife portion 16 which fits through the slit 14 when in an open position as shown in FIG. 1. 18 is a metal or flint striker affixed to the end of container 10 while 20 is a match striker such as sandpaper affixed to the base 22 of knife blade 16, while 24 is a water tight gasket which fits inside the lid 12 when the knife is enclosed inside the container 10 in a closed position and 26 is an "O" ring to also seal the lid 12 to the container 10 in a closed position by means of threads 28. 30 are matches being carried in the container.

Now it will be readily seen that when matches are placed in the container and the gasket placed on the inside of the cap or lid with the knife portion also buried on the inside of the container with the matches, and the cap or lid is secured in place, that the gasket and the "O" ring seal the lid or cap in a water tight manner and the device, now being in a closed position, can easily be carried in a pocket or the like, with no edges of the knife or the matches being exposed.

It will also be readily seen that when the device is opened and the gasket removed, the knife can be inserted through the slit in the cap or lid and the cap or lid again secured to the container and the container now becomes a handle for the knife.

Also, the knife can be removed and struck sharply against the metal striker provided on one end of the container and the sparks thus generated may be used to start a fire.

Also, the matches are kept on the inside of the dry and protected container, which may be made of plastic or the like, when not in use and can readily be struck by striking them against the portion of the base of the knife which is covered with sandpaper or the like for ease of striking.

While the invention has been described in terms of a preferred embodiment, there is no intent to limit the invention to the same. On the contrary, it is intended to cover all equivalents and modifications within the scope of the appended claims.

What we claim and wish to secure by letters patent is:

1. A combination match safe, knife and strikers comprising; a container, means for closing said container, means for sealing said container, a knife, said knife having a blade portion and a base portion, said base portion being substantially perpendicular to one end of said knife blade, said base portion and said knife portion having means cooperating with said container and said means for closing said container in a first and second position, said first position being one in which said knife blade is enclosed and sealed in said container, said second position being one in which said knife blade is exposed on the outside of said container, said base portion having a striking surface, and a second striking surface affixed to the outside surface of said container.

2. The device of claim 1 in which said container is substantially a cylinder.

3. The device of claim 1 in which said means for closing said container is a cap cooperating with said container.

4. The device of claim 1 in which said means for sealing said container is a gasket and an "O" ring cooperating with said container and said means for closing.

5. The device of claim 1 in which said knife has two opposed sharpened edges.

6. The device of claim 1 in which said knife and said knife base portion cooperating with said container and said means for closing said container in a said first and said second position, is a slit in said means for closing said container, said slit cooperating with said knife blade to allow said knife blade to protrude through said slit when in said second position.

7. The device of claim 1 in which said container is large enough to hold the said knife blade and an unspecified number of matches.

8. The device of claim 1 in which said container is made of plastic.

9. The device of claim 1 in which said second striker is a flint.

* * * * *